US009638470B2

(12) United States Patent
Dziubinschi et al.

(10) Patent No.: US 9,638,470 B2
(45) Date of Patent: May 2, 2017

(54) COMPACT LOW PRESSURE DROP HEAT EXCHANGER

(71) Applicant: Halla Visteon Climate Control Corp., Daejeon (KR)

(72) Inventors: Orest Alexandru Dziubinschi, Dearborn, MI (US); Kastriot Shaska, Northville, MI (US); Brian James Cardwell, Ypsilanti, MI (US)

(73) Assignee: HANON SYSTEMS, Daejeon-si (KR)

( * ) Notice: Subject to any disclaimer, the term of this patent is extended or adjusted under 35 U.S.C. 154(b) by 210 days.

(21) Appl. No.: 14/505,547

(22) Filed: Oct. 3, 2014

(65) Prior Publication Data

US 2015/0096729 A1 Apr. 9, 2015

Related U.S. Application Data

(60) Provisional application No. 61/887,582, filed on Oct. 7, 2013.

(51) Int. Cl.

| | |
|---|---|
| ***F28D 1/053*** | (2006.01) |
| ***F28F 9/26*** | (2006.01) |
| ***F28F 27/02*** | (2006.01) |
| *F28D 21/00* | (2006.01) |
| *F01P 3/18* | (2006.01) |

(52) U.S. Cl.

CPC ..... *F28D 1/05316* (2013.01); *F28F 9/262* (2013.01); *F28F 27/02* (2013.01); *F01P 2003/185* (2013.01); *F28D 2021/0089* (2013.01); *F28D 2021/0094* (2013.01); *F28F 2250/06* (2013.01)

(58) Field of Classification Search

CPC .... F28F 9/0221; F28F 9/0202; F28F 2255/00; F28D 1/0476; F28D 1/0478; F28D 1/05375; F28D 1/05383

USPC ..... 165/174, 140, 175

See application file for complete search history.

(56) References Cited

U.S. PATENT DOCUMENTS

| | | | | |
|---|---|---|---|---|
| 7,073,570 | B2 | 7/2006 | Yu et al. | |
| 8,726,976 | B2 * | 5/2014 | Schrader | F28D 1/0426 165/140 |
| 9,016,355 | B2 * | 4/2015 | Hirai | F28D 1/0461 165/104.19 |
| 2014/0290923 | A1 * | 10/2014 | Huelsmann | F28F 9/0214 165/174 |

FOREIGN PATENT DOCUMENTS

| | | | |
|---|---|---|---|
| JP | 02-130391 | A | 5/1990 |
| JP | 2010510471 | A | 4/2010 |
| JP | 2013047585 | A | 3/2013 |
| KR | 20080065812 | A | 7/2008 |
| KR | 20100024228 | A | 3/2010 |

* cited by examiner

*Primary Examiner* — Davis Hwu

(74) *Attorney, Agent, or Firm* — Fraser Clemens Martin & Miller LLC; James D. Miller

(57) ABSTRACT

Disclosed herein is a heat exchanger in a vehicle including a supply manifold which supplies fluid introduced from the outside while distributing the fluid to first and second cooling units. The first and second cooling units cool the fluid supplied from the supply manifold by heat exchange action. A first return manifold collects and discharges the fluid discharged from the first cooling unit and a second return manifold collects and discharges the fluid discharged from the second cooling unit.

19 Claims, 2 Drawing Sheets

COMPACT LOW PRESSURE DROP HEAT EXCHANGER

CROSS-REFERENCE TO RELATED APPLICATIONS

This application claims priority to U.S. provisional Application No. 61/887,582, filed on Oct. 7, 2013, the disclosure of which is incorporated herein by reference in its entirety.

FIELD OF THE INVENTION

Exemplary embodiments of the present invention relate to a heat exchanger in a vehicle, and more particularly, to a heat exchanger in a vehicle, which cools engine coolant or transmission oil of a vehicle, or hydraulic oil.

BACKGROUND OF THE INVENTION

In general, a transmission in a vehicle is supplied with oil in order to lubricate rotary bodies such as a torque converter, a gear, and a bearing. Hydraulic oil is used for a variety of hydraulic mechanisms such as a clutch and a brake. Coolant is used to cool an engine.

When such oil or coolant is increased in temperature, an overflow phenomenon is generated to thereby cause malfunction of the devices. Therefore, a cooler or a heat exchanger is used to maintain the temperature of oil or coolant below a certain temperature.

As shown in FIG. 1, conventional TOCs (Transmission Oil Coolers) each include a first manifold 120 which supplies fluid introduced from the outside to a cooling unit 110, the cooling unit 110 which cools the fluid supplied from the first manifold 120 by heat exchange action, and a second manifold 130 which collects and discharges the fluid discharged from the cooling unit 110.

The fluid introduced from a transmission into the first manifold 120 via a supply passage 125 is cooled by heat exchange with outdoor air during passing through the cooling unit 110, and is then discharged to the second manifold 130. Subsequently, the discharged fluid passes through a discharge passage 135 and is then circulated to the transmission. An example similar to the structure shown in FIG. 1 is disclosed in U.S. Pat. No. 7,073,570.

The conventional cooling unit 110 has a maximum length which is allowable in a limited space such as an engine room of the vehicle. Accordingly, there is a problem in that fluid significantly drops in pressure when reaching the second manifold 130 from the first manifold 120. Since this adversely affects a pumping device for forcibly circulating fluid, heat exchange efficiency may be reduced.

SUMMARY OF THE INVENTION

The present invention has been made in view of the above-mentioned problem, and an object thereof is to provide a heat exchanger in a vehicle, which has a stable structure by minimizing a pressure drop in fluid and enhancing thermal durability against a change in temperature.

Other objects and advantages of the present invention can be understood by the following description and become apparent with reference to the embodiments of the present invention. Also, it is obvious to those skilled in the art to which the present invention pertains that the objects and advantages of the present invention can be realized by the means as claimed and combinations thereof.

In accordance with one aspect of the present invention, a heat exchanger in a vehicle includes a supply manifold which supplies fluid introduced from the outside while distributing the fluid to first and second cooling units. The first cooling unit cools the fluid supplied from the supply manifold by heat exchange action. A first return manifold collects and discharges the fluid discharged from the first cooling unit. The second cooling unit cools the fluid supplied from the supply manifold by heat exchange action. A second return manifold collects and discharges the fluid discharged from the second cooling unit.

In the heat exchanger in a vehicle, the supply manifold may be provided between the first and second return manifolds.

In the heat exchanger in a vehicle, the first and second cooling units may be provided opposite to each other with the supply manifold being interposed therebetween.

In the heat exchanger in a vehicle, the first cooling unit may include first cooling passages through which the fluid is transferred from the supply manifold to the first return manifold and first cooling fins which come into contact with the first cooling passages so as to emit heat.

In the heat exchanger in a vehicle, the first cooling passages may be formed in a direction across the supply manifold.

In the heat exchanger in a vehicle, the second cooling unit may include second cooling passages through which the fluid is transferred from the supply manifold to the second return manifold and second cooling fins which come into contact with the second cooling passages so as to emit heat.

In the heat exchanger in a vehicle, the second cooling passages may be formed in a direction across the supply manifold.

The heat exchanger in a vehicle may further include a supply passage through which the fluid is supplied from the outside to the supply manifold, and the supply passage may be fixedly coupled to the first return manifold and the supply manifold.

The heat exchanger in a vehicle may further include a bypass passage provided such that the fluid introduced into the supply manifold is bypassed to the first return manifold without passing through the first cooling unit.

In the heat exchanger in a vehicle, the bypass passage may be fixedly coupled to the supply manifold and the first return manifold.

The heat exchanger in a vehicle may further include a first opening and closing unit which adjusts a discharge amount of the fluid discharged from the bypass passage to the first return manifold.

The heat exchanger in a vehicle may further include a second opening and closing unit which adjusts a discharge amount of the fluid discharged from the second return manifold.

In the heat exchanger in a vehicle, the fluid supplied to the supply manifold may be transmission oil or engine coolant.

The heat exchanger in a vehicle may further include a first discharge passage through which the fluid discharged from the first return manifold is transferred and a second discharge passage through which the fluid discharged from the second return manifold is transferred.

In the heat exchanger in a vehicle, the first discharge passage may be fixedly coupled to the first return manifold, the supply manifold, and the second return manifold.

The heat exchanger in a vehicle may further include a main discharge passage through which the fluid in the first and second discharge passages is transferred to a transmission.

It is to be understood that both the foregoing general description and the following detailed description of the present invention are exemplary and explanatory and are intended to provide further explanation of the invention as claimed.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF EXEMPLARY EMBODIMENTS OF THE INVENTION

Exemplary embodiments of the present invention will be described below in more detail with reference to the accompanying drawings.

Although fluid to be cooled used in the present invention includes transmission oil, engine coolant, or hydraulic oil of a variety of hydraulic mechanisms, the transmission oil will be described as an example in the following embodiment.

Figure 2:
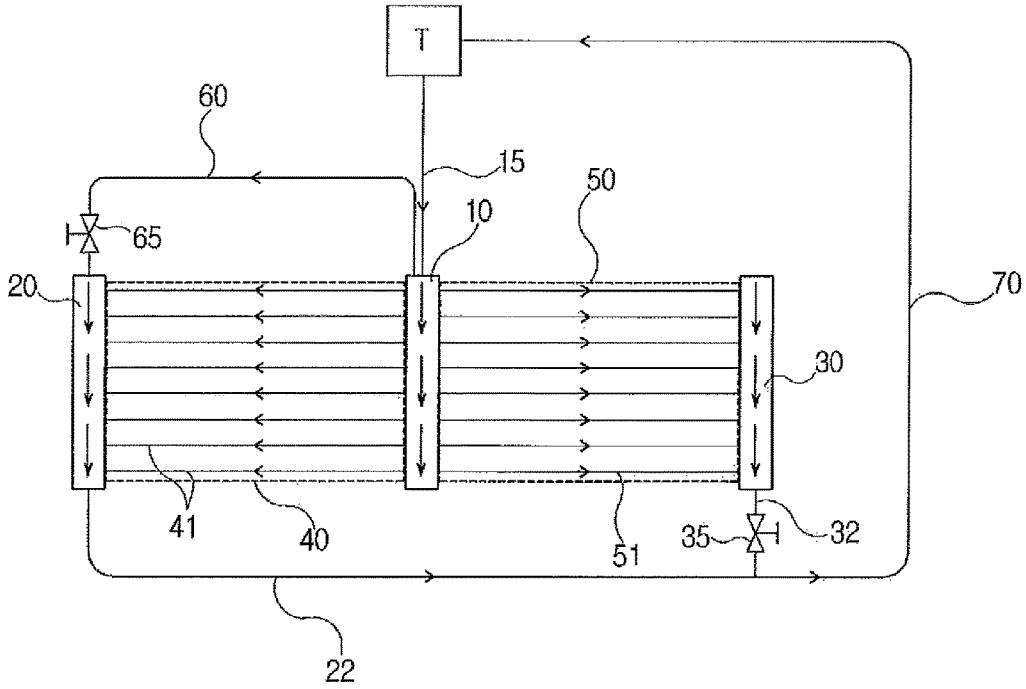
FIG. 2 is a view illustrating a configuration of a heat exchanger in a vehicle according to an embodiment of the present invention.
Figure 3:
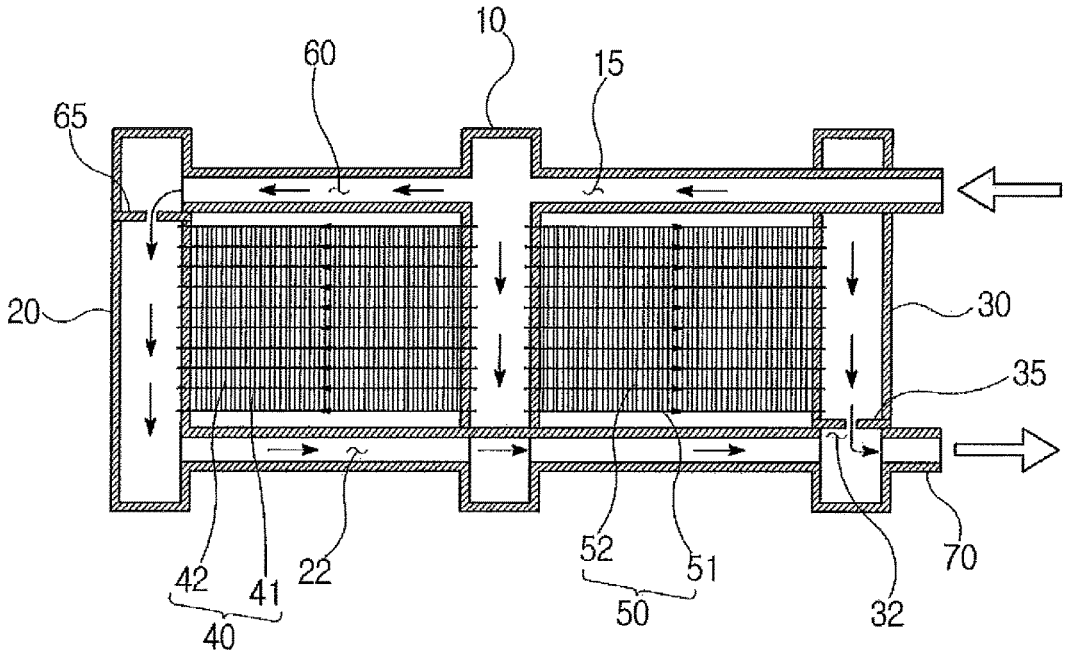
FIG. 3 is a cross-sectional view schematically illustrating an example of the heat exchanger in a vehicle shown in FIG. 2.

Referring to FIGS. 2 and 3, a heat exchanger in a vehicle according to an embodiment of the present invention includes a supply manifold 10 which supplies fluid introduced from a transmission while distributing the fluid to first and second cooling units 40 and 50. The first cooling unit 40 cools the fluid supplied from the supply manifold 10 by heat exchange action. A first return manifold 20 collects and discharges the fluid discharged from the first cooling unit 40. The second cooling unit 50 cools the fluid supplied from the supply manifold 10 by heat exchange action. A second return manifold 30 collects and discharges the fluid discharged from the second cooling unit 50.

The supply manifold 10 is supplied with fluid through a supply passage 15 from the transmission. The first and second cooling units 40 and 50 are arranged at both sides of the supply manifold 10, respectively.

The first and second cooling units 40 and 50 are provided opposite to each other with the supply manifold 10 being interposed therebetween. The supply manifold 10 supplies fluid while distributing the fluid to the first and second cooling units 40 and 50.

The first cooling unit 40 includes first cooling passages 41 through which fluid is transferred from the supply manifold 10 to the first return manifold 20, and first cooling fins 42 which come into contact with the first cooling passages 41 so as to emit heat.

The first cooling passages 41 communicate with the supply manifold 10 so that fluid is introduced from the supply manifold 10 to the first cooling passages 41. The fluid passing through the first cooling passages 41 is cooled during heat exchange with the first cooling fins 42. The first cooling passages 41 communicate with the first return manifold 20.

The second cooling unit 50 includes second cooling passages 51 through which fluid is transferred from the supply manifold 10 to the second return manifold 30 and second cooling fins 52 which come into contact with the second cooling passages 51 so as to emit heat.

The first and second cooling passages 41 and 51 are formed in a direction across the supply manifold 10. Each of the first and second cooling passages 41 and 51 are provided at predetermined intervals in a longitudinal direction of the supply manifold 10. The first cooling fins 42 are arranged between the respective first cooling passages 41 and the second cooling fins 52 are arranged between the respective second cooling passages 51.

The first and second cooling passages 41 and 51 extend from the supply manifold 10 in directions opposite to each other so that the fluid in the supply manifold 10 is distributed and introduced into the first and second cooling passages 41 and 51.

As such, when the supply manifold 10 is located at a center between the first and second cooling units 40 and 50 such that fluid is distributed to both sides of the supply manifold 10, a moving distance of the fluid is shortened and resistance of the fluid is decreased, thereby enabling a pressure drop in the fluid to be reduced.

Figure 1:
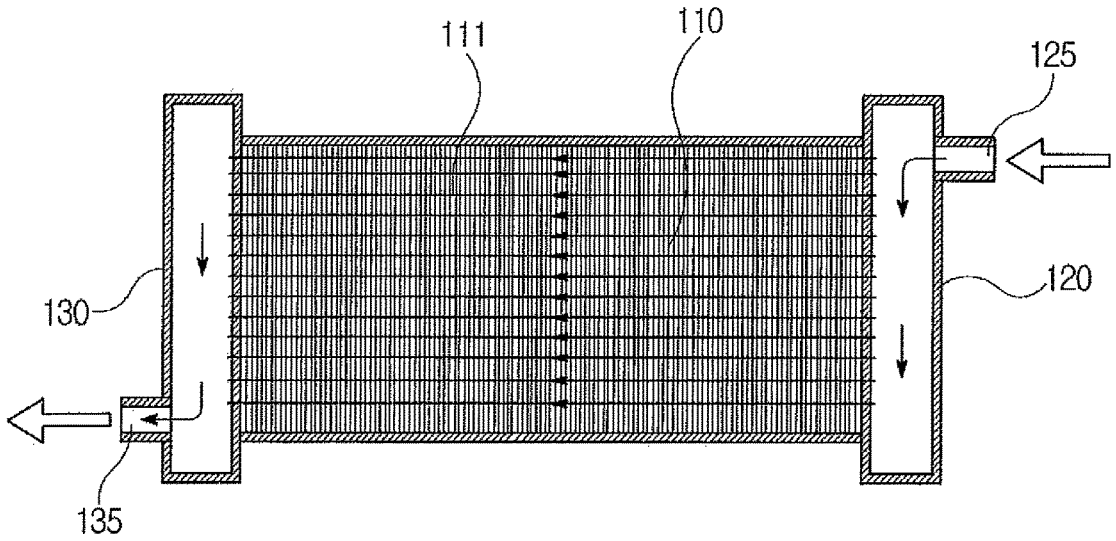
FIG. 1 is a cross-sectional view schematically illustrating a heat exchanger in a vehicle according to the related art.

That is, when a sum of heat exchange areas of the respective first and second cooling units 40 and 50 is equal to that of one conventional cooling unit 110 shown in FIG. 1, the moving distance of fluid in the first or second cooling unit 40 or 50 is half that in the conventional cooling unit 110. Since the length of each first cooling passage 41 in the first cooling unit 40 is half that of each cooling passage 111 in the conventional cooling unit 110, the moving distance of the fluid passing through the first cooling passages 41 is shortened by half compared to the conventional distance, thereby allowing resistance on the heat exchange passage to be decreased.

Meanwhile, the first and second cooling passages 41 and 51 are connected in parallel with respect to the supply manifold 10. Therefore, the connection between the first and second cooling passages 41 and 51 is similar to a case where two resistances R are connected in parallel. On the other hand, the connection between the conventional cooling passages 111 is similar to a case where two resistances R are connected in series.

That is, an overall resistance in the series connection is indicated by the following equation.

$$R_{total}=R_1+R_2$$

An overall resistance in the parallel connection is indicated by the following equation.

$$\frac{1}{R_{total}}=\frac{1}{R_1}+\frac{1}{R_2}$$

A sum of resistances R connected in series is 2R, whereas a sum of resistances connected in parallel is 0.5R. Accordingly, the overall resistance of the first and second cooling units 40 and 50 is decreased by four times that of the conventional cooling unit 110. This means that a pressure drop in fluid is reduced by one fourth compared to the related art. As such, when the pressure does not significantly drop, the load of the pumping device for forcibly circulating fluid is reduced.

In addition, when the moving distance of fluid is shortened, thermal gradients between both ends of a movement section, namely, both ends of the first cooling unit 40 are reduced, thereby allowing thermal durability to be enhanced.

The fluid discharged from the first cooling passages 41 is introduced into the first return manifold 20 and the fluid discharged from the second cooling passages 51 is introduced into the second return manifold 30. The first and second return manifolds 20 and 30 are provided opposite to each other with the supply manifold 10 being interposed therebetween.

The fluid discharged from the first return manifold 20 is discharged through a first discharge passage 22 to a main discharge passage 70 and the fluid discharged from the second return manifold 30 is discharged through a second discharge passage 32 to the main discharge passage 70. The main discharge passage 70 allows the fluid in the first and second discharge passages 22 and 32 to be combined in one passage so that the combined fluid is transferred to the transmission.

One side of a lower end of the second return manifold 30 is provided with a second opening and closing unit 35 which adjusts a discharge amount of fluid.

The second opening and closing unit 35 adjusts a discharge amount of fluid discharged from the second return manifold 30 to the second discharge passage 32 according to a discharge amount of fluid discharged from the first return manifold 20 to the first discharge passage 22.

The second opening and closing unit 35 may also be provided in an orifice or baffle form. In addition, all types of devices are applicable so long as a device such as a valve may adjust an opening and closing area of the passage.

A bypass passage 60 is connected between the supply manifold 10 and the first return manifold 20. One end of the bypass passage 60 is connected to an upper end of the supply manifold 10 and the other end thereof is connected to an upper end of the first return manifold 20. The bypass passage 60 is provided such that the fluid in the supply manifold 10 is bypassed to the first return manifold 20 without passing through the first cooling unit 40. That is, a portion of the fluid introduced into the supply manifold 10 is discharged through the bypass passage 60 to the first return manifold 20 so that a flow rate supplied to the first and second cooling units 40 and 50 is adjusted.

The first return manifold 20 is provided therein with a first opening and closing unit 65 which adjusts a discharge amount of fluid discharged from the bypass passage 60.

The first opening and closing unit 65 adjusts a flow rate which is bypassed from the supply manifold 10 to the bypass passage 60 so as to adjust a flow rate supplied from the supply manifold 10 to the first and second cooling units 40 and 50 as two parallel passages.

Hot fluid introduced into the supply manifold 10 is directly introduced into the first return manifold 20 without passing through the first cooling unit 40 by the bypass passage 60 and is then mixed with fluid passing through the first cooling unit 40 in the first return manifold 20.

The fluid passing through the first cooling unit 40 is increased in temperature due to the hot fluid introduced from the bypass passage 60, and thermal gradients between the mixed fluid in the first return manifold 20 and the fluid in the supply manifold 10 are decreased. As a result, it may be possible to enhance durability against thermal cycles which repeat heating and cooling.

The fluid in the transmission is introduced through the supply passage 15 to the supply manifold 10 and is then circulated back to the transmission through the main discharge passage 70.

As shown in FIG. 2, the supply passage 15 is provided above the second cooling unit 50 in parallel with the second cooling passages 51, and both ends thereof are fixedly coupled to the first return manifold 20 and the supply manifold 10.

The first discharge passage 22 is provided below the second cooling unit 50 in parallel with the second cooling passages 51, and forms a lattice structure together with the supply passage 15, the first return manifold 20, and the supply manifold 10.

The first discharge passage 22 is provided below the first and second cooling units 40 and 50 in parallel with the first and second cooling passages 41 and 51, and is fixedly coupled to the first return manifold 20, the supply manifold 10, and the second return manifold 30. That is, both ends of the first discharge passage 22 are fixedly coupled to lower ends of the first and second return manifolds 20 and 30, respectively, and a central portion of the first discharge passage 22 is fixedly coupled to a lower end of the supply manifold 10.

The bypass passage 60 is provided above the first cooling unit 40 in parallel with the first cooling passages 41, and both ends thereof are fixedly coupled to upper ends of the first return manifold 20 and the supply manifold 10.

The supply manifold 10 and the first and second return manifolds 20 and 30 are provided at predetermined intervals in parallel with each other and function as three structural columns. At the same time, since the supply passage 15, the bypass passage 60, and the first discharge passage 22 are provided in a transverse direction, the heat exchanger in a vehicle has a stable lattice structure as a whole. Thus, it may be possible to enhance structural durability against vibration of the vehicle or external impact.

As is apparent from the above description, in accordance with a heat exchanger in a vehicle, fluid is distributed in parallel and exchanges heat so as to shorten a moving distance of the fluid, thereby enabling a pressure drop in fluid to be minimized and thermal durability against a change in temperature to be enhanced. In addition, since the heat exchanger in a vehicle has a lattice form which is a stable structure as a whole, it may be possible to enhance durability against vibration or external impact.

While the present invention has been described with respect to the specific embodiments, it will be apparent to those skilled in the art that various changes and modifications may be made without departing from the spirit and scope of the invention as defined in the following claims.

What is claimed is:

1. A heat exchanger of a vehicle comprising:

a supply manifold configured to receive a transmission fluid flowing from a transmission of the vehicle;

a first cooling unit in fluid communication with the supply manifold and configured to provide heat exchange communication between the transmission fluid and air;

a second cooling unit in fluid communication with the supply manifold and configured to provide heat exchange communication between the transmission fluid and the air;

a first return manifold in fluid communication with the first cooling unit and configured to receive and discharge the transmission fluid from the first cooling unit; and a second return manifold in fluid communication with the second cooling unit and configured to receive and discharge the transmission fluid from the second cooling unit, wherein the supply manifold is disposed intermediate the first return manifold and the second return manifold.

2. The heat exchanger according to claim 1, wherein the supply manifold is disposed intermediate the first cooling unit and the second cooling unit.

3. The heat exchanger according to claim 1, wherein the first cooling unit and the second cooling unit extend from the supply manifold in opposite directions from each other.

4. The heat exchanger according to claim 1, wherein the first cooling unit includes a plurality of first cooling passages configured for conveying the transmission fluid through the first cooling unit and a plurality of first cooling fins contacting the first cooling passages and configured to facilitate heat exchange communication between the transmission fluid in the first cooling passages and the air, and wherein the second cooling unit includes a plurality of second cooling passages configured for conveying the transmission fluid through the second cooling unit and a plurality of second cooling fins contacting the second cooling passages and configured to facilitate heat exchange communication between the transmission fluid in the second cooling passages and the air.

5. The heat exchanger according to claim 4, wherein the first cooling passages and the second cooling passages are disposed substantially perpendicular to a longitudinal direction of the supply manifold, wherein a direction of the transmission fluid through the first cooling passages is opposite a direction of the transmission fluid conveyed through the second cooling passages.

6. The heat exchanger according to claim 1, further comprising a supply passage in fluid communication with and intermediate the transmission of the vehicle and the supply manifold.

7. The heat exchanger according to claim 1, further comprising a bypass passage disposed intermediate and in fluid communication with the supply manifold and the first return manifold, the bypass passage bypassing the first cooling unit.

8. The heat exchanger according to claim 7, further comprising a first opening and closing unit in fluid communication with the bypass passage and adjustably controlling an amount of the transmission fluid conveyed from the bypass passage to the first return manifold.

9. The heat exchanger according to claim 7, further comprising a second opening and closing unit in fluid communication with the second return manifold and adjustably controlling an amount of the transmission fluid discharged from the second return manifold.

10. The heat exchanger according to claim 7, wherein the bypass passage is fixedly coupled to the supply manifold and the first return manifold.

11. The heat exchanger according to claim 1, further comprising a first discharge passage in fluid communication with and disposed downstream from the first return manifold and a second discharge passage in fluid communication with and disposed downstream from the second return manifold.

12. The heat exchanger according to claim 11, wherein the first discharge passage is fixedly coupled to the first return manifold, the supply manifold, and the second return manifold.

13. The heat exchanger according to claim 11, further comprising a main discharge passage disposed downstream of and in fluid communication with the first discharge passage and the second discharge passage, the main discharge passage configured to convey the transmission fluid to the transmission of the vehicle.

14. The heat exchanger in a vehicle according to claim 1, wherein the transmission fluid is one of a transmission oil and an engine coolant.

15. A heat exchanger of a vehicle comprising:

a supply manifold configured to receive a transmission fluid flowing from a transmission of the vehicle;

a first cooling unit in fluid communication with the supply manifold and configured to provide heat exchange communication between the transmission fluid and air;

a second cooling unit in fluid communication with the supply manifold and configured to provide heat exchange communication between the transmission fluid and the air, the supply manifold is disposed intermediate the first cooling unit and the second cooling unit;

a first return manifold disposed downstream of and in fluid communication with the first cooling unit and configured to receive and discharge the transmission fluid from the first cooling unit; and a second return manifold disposed downstream of and in fluid communication with the second cooling unit and configured to receive and discharge the transmission fluid from the second cooling unit, and a bypass passage disposed intermediate and in fluid communication with the supply manifold and the first return manifold and bypassing the first cooling unit, a first discharge passage in fluid communication with and disposed downstream from the first return manifold, and a second discharge passage in fluid communication with and disposed downstream from the second return manifold.

16. The heat exchanger according to claim 15, wherein the first cooling unit and the second cooling unit extend from the supply manifold in opposite directions from each other, and wherein a direction of the transmission fluid through the first cooling unit is opposite a direction of the transmission fluid through the second cooling passages.

17. The heat exchanger according to claim 15, wherein the first cooling unit includes a plurality of first cooling passages configured for conveying the transmission fluid through the first cooling unit and a plurality of first cooling fins contacting the first cooling passages and configured to facilitate heat exchange communication between the transmission fluid in the first cooling passages and the air, wherein the second cooling unit includes a plurality of second cooling passages configured for conveying the transmission fluid through the second cooling unit and a plurality of second cooling fins contacting the second cooling passages and configured to facilitate heat exchange communication between the transmission fluid in the second cooling passages and the air, and wherein the first cooling passages and the second cooling passages are disposed substantially perpendicular to a longitudinal direction of the supply manifold.

18. A heat exchanger of a vehicle comprising:

a supply manifold configured to receive a transmission fluid flowing from a transmission of the vehicle;

a first cooling unit in fluid communication with the supply manifold and configured to provide heat exchange communication between the transmission fluid and air;

a second cooling unit in fluid communication with the supply manifold and configured to provide heat exchange communication between the transmission fluid and the air;

a first return manifold in fluid communication with the first cooling unit and configured to receive and discharge the transmission fluid from the first cooling unit;

a second return manifold in fluid communication with the second cooling unit and configured to receive and discharge the transmission fluid from the second cooling unit, and a bypass passage disposed intermediate and in fluid communication with the supply manifold and the first return manifold, the bypass passage bypassing the first cooling unit.

19. The heat exchanger according to claim 18, further comprising a first opening and closing unit in fluid communication with the bypass passage and adjustably controlling an amount of the transmission fluid conveyed from the bypass passage to the first return manifold.

* * * * *